United States Patent [19]

Macdonald

[11] 4,319,922

[45] Mar. 16, 1982

[54] RECOVERY OF GOLD FROM AN ETCHING SOLUTION

[75] Inventor: David I. Macdonald, Revere, Mass.

[73] Assignee: Western Electric Company, Inc., New York, N.Y.

[21] Appl. No.: 106,993

[22] Filed: Dec. 26, 1979

[51] Int. Cl.[3] ..... C22B 11/04

[52] U.S. Cl. ..... 75/108; 75/0.5 A; 75/118 R; 75/121

[58] Field of Search ..... 75/108, 118 R, 118 P, 75/121, 0.5 A

[56] References Cited

U.S. PATENT DOCUMENTS

| | | | |
|---|---|---|---|
| 3,390,981 | 7/1968 | Hoffman | 75/118 R |
| 3,495,976 | 2/1970 | Bazilevsky et al. | 75/101 R |
| 3,576,620 | 4/1971 | Wilson | 75/101 R |
| 3,709,681 | 1/1973 | Wilson | 75/109 |
| 3,778,252 | 12/1973 | Wilson | 75/101 R |
| 3,832,308 | 8/1974 | Holmes et al. | 75/118 R X |
| 3,856,507 | 12/1974 | Brug et al. | 75/0.5 A |
| 3,885,955 | 5/1975 | Lutz et al. | 75/0.5 A |
| 3,957,505 | 5/1976 | Homick et al. | 75/108 |
| 4,131,454 | 12/1978 | Piret et al. | 75/118 R X |
| 4,131,455 | 12/1978 | Edwards et al. | 75/118 R |

OTHER PUBLICATIONS

Lindenborg, *Western Electric Co.-Technical Digest,* No. 45, Jan. 1977, pp. 23 and 24.

*Primary Examiner*—G. Ozaki
*Attorney, Agent, or Firm*—D. D. Bosben

[57] ABSTRACT

A method of recovering gold and palladium from a spent aqueous potassium iodide-iodine etching solution, and regenerating the etching solution for reuse, involves adjusting the spent solution to a strongly basic pH (e.g., 12.5) by the addition of an alkaline compound (e.g., potassium hydroxide) to precipitate metallic gold from the solution. Metallic palladium is precipitated from the resulting alkaline solution by the addition of a borohydride, (e.g., potassium borohydride). Following removal of the precipitated gold and palladium, the spent alkaline solution is made acidic-to-neutral in pH to change potassium hypoiodite and some potassium iodide in the solution to iodine. The solution then is adjusted back upward to a slightly alkaline pH value (e.g., 9.0), and precipitate is removed at room temperature. Potassium iodide and iodine crystals then are added to the solution, as necessary, to regenerate the solution to substantially its original composition and strength for reuse.

9 Claims, No Drawings

RECOVERY OF GOLD FROM AN ETCHING SOLUTION

TECHNICAL FIELD

This invention relates to the recovery of gold from an etching solution, and more particularly to the recovery of gold from an aqueous potassium iodide-iodine etching solution, and the regeneration of the etching solution for reuse.

BACKGROUND OF THE INVENTION

The manufacture of thin film circuit devices involves the etching of gold and palladium from substrates with an aqueous potassium iodide-iodine etching solution, to form thin film circuit patterns on the substrates. As gold is dissolved into the etching solution, the etching solution becomes spent and the etching rate of the solution decreases to a point where the solution is no longer effective in a manufacturing process.

It then is desirable to remove the expensive gold and palladium metals from the spent etching solution for reuse. Preferably, this should be accomplished in a manner which does not contaminate the etching solution, so that the etching solution also can be regenerated for reuse after the gold and palladium have been removed. Accordingly, a purpose of this invention is to provide a relatively simple and economical method of recovering gold from a spent aqueous potassium iodide-iodine etching solution and then regenerating the spent etching solution to substantially its original strength.

An evaporation-type process for recovering a spent aqueous potassium iodide-iodine solution which has been used for the etching of gold, is disclosed on pages 23 and 24 of the January, 1977 issue of the Western Electric *Technical Digest* No. 45. In this process, a metered charge of the spent etching solution is transferred into a sealed heat chamber containing an inert atmosphere (carbon dioxide) to prevent oxidation. The charge of spent etching solution is then heated so that water vapor is driven from the aqueous solution and passes through a heated conduit to a relatively cool potassium iodide solution, in which the water vapor is condensed. As the water in the spent etching solution distills, some unreacted iodine also is carried over into the potassium iodide solution. Driving off of the water from the spent etching solution leaves a powder residue of potassium iodoaurate, unreacted iodine and potassium iodide. Continued application of heat then causes a thermal decomposition of the powder, causing the unreacted iodine to be driven off as a gas into the potassium iodide solution, in which it becomes dissolved to produce a potassium iodide-iodine etching solution. As the heating continues, the potassium iodoaurate is decomposed to produce a solid dry mixture of gold and potassium iodide, which then is placed in water to dissolve the potassium iodide, leaving the gold in a free metallic state. The gold is then recovered from this solution by filtering and the filtered potassium iodide solution may be used to collect the iodine gas during the heating process, thus regenerating the original etching solution for reuse.

The Homick et al. U.S. Pat. No. 3,957,505 discloses a process for reclaiming gold in which dissolved gold in an aqueous potassium iodide-iodine solution is precipitated from the solution by the addition of hydrazine and sodium hydroxide. After removal of the precipitated gold from the solution, the solution is restored to its original condition by the addition of hydrogen peroxide.

The Wilson U.S. Pat. No. 3,709,681 is directed to a process for the recovery of noble metals utilizing a solvent comprising diacetone alcohol as the major component, water, and minor amounts of glacial acetic acid, potassium iodide and elemental iodine. Solvation of the noble metal occurs during heating and agitation of the resultant slurry and removal of the noble metal is achieved by displacement thereof onto a non-noble metal surface. Aqueous hydroxide then is used to convert any excess non-noble metal to its water-soluble salt. The remaining insoluble material then is rinsed to remove any remaining unreacted alkali and the water-soluble salts, and is digested with concentrated sulfuric acid to dissolve any remaining and soluble impurities. The remaining acid insoluble residue, which is then rinsed and dried, comprises substantially pure noble metal. A similar process, for the recovery of gold in an iodine-containing solvent, also is disclosed in the Wilson U.S. Pat. No. 3,778,252.

It is known that when an aqueous iodine solution is made basic, it undergoes a hypohalite reaction in which the iodine is consumed, producing hypoiodite, iodide and water.

SUMMARY OF THE INVENTION

In general, a method of recovering gold from an aqueous potassium iodide-iodine etching solution comprises the adjusting of the solution to a strongly basic pH to precipitate metallic gold from the solution. More specifically, the pH of the aqueous potassium iodide-iodine etching solution is adjusted to a value on the order of at least 12.5 by the addition of an alkaline compound, such as potassium hydroxide, to precipitate the metallic gold from the etching solution. After removal of the precipitated gold, the alkaline solution is adjusted to a neutral pH, such as by the addition of sulfuric acid to the solution, to change iodine compounds in the solution to iodine. The solution then is adjusted to a slightly alkaline pH and any formed precipitate is removed. Iodine then is added to the solution, as necessary, to regenerate the solution for reuse.

DETAILED DESCRIPTION

The disclosed embodiment of the invention is directed to a method of recovering gold and palladium from a spent aqueous potassium iodide-iodine etching solution which has been used to etch gold and palladium from thin film circuit devices. The spent etching solution then may be discarded, but preferably is regenerated to substantially its original composition and strength for reuse.

Initially, the spent etching solution is adjusted to a strongly basic pH to precipitate metallic gold from the spent etching solution. Preferably, where the etching solution is to be regenerated for reuse, the adjustment of the pH of the spent etching solution is accomplished using an alkaline compound, such as potassium hydroxide, which will not introduce another cation into the solution. Where the spent etching solution is to be discarded, other alkaline compounds, such as sodium hydroxide, may be used, if so desired.

In accordance with this invention, it has been found that the addition of an alkaline compound, such as potassium hydroxide (KOH), to the spent potassium iodide-iodine etching solution ($KI+I_2+AuI_4^-$) to adjust the solution to a strongly basic pH as noted above, initially causes consumption of the iodine ($I_2$) in the solution. After the iodine has been consumed, the dissolved gold in the spent etching solution, in the form of gold iodoaurate ($AuI_4^-$), precipitates metallic gold (Au) with potassium hypoiodite (KOI) and potassium iodide (KI) remaining in the resulting alkaline solution. The reaction involved is illustrated by the following equation:

$$KI + I_2 + AuI_4^- \xrightarrow{KOH} KOI + KI + Au\downarrow + H_2O$$

The precipitated gold then may be removed from the spent alkaline solution in a suitable manner, such as by centrifuging, filtering, decanting, etc. In the alternative, the gold may be left in the spent alkaline solution and subsequently removed from the solution with any palladium in the solution, as a mixture.

Since spent aqueous potassium iodide-iodine etching solutions generally contain various amounts of iodine, the amount of alkaline compound required to consume the iodine varies from batch to batch. However, it has been found that by adding an alkaline compound until the pH of the spent etching solution is on the order of at least 12.5, the desired precipitation of the metallic gold will take place. For example, in various spent etching solutions adjusted to a pH on the order of at least 12.5, an analysis of the spent etching solutions by atomic absorption spectroscopy after removal of the gold therefrom generally shows a remaining gold content on the order of 10 ppm. Further, chemical assays of the precipitated gold generally show a gold content on the order of 99.5%±0.2%.

It has been found that the dissolved palladium in each spent etching solution generally has no significant effect upon the etching effectiveness of the etching solution when the solution has been regenerated to substantially its original strength as described herein. However, if the palladium is permitted to accumulate in the etching solution beyond more than one metal recovery-and-regenerating cycle, a palladium haze may form on the substrates being etched during the etching process, requiring subsequent additional chemical treatment and/or scrubbing of the substrates to remove the haze.

After the gold has been precipitated from the spent etching solution as described above, metallic palladium may be precipitated from the resulting alkaline solution by the addition of a borohydride compound. Preferably, as in the case of the precipitation of gold from the spent etching solution, where the spent etching solution subsequently is to be regenerated for reuse a compound such as potassium borohydride, which will not introduce another cation into the etching solution, is used. Where the etching solution is not to be regenerated for use, other borohydride compounds, such as sodium borohydride, may be used, if so desired.

When potassium borohydride ($KBH_4$) is added to the spent alkaline solution, metallic palladium (Pd) is precipitated leaving iodide ions ($I^-$) and borate ions ($BO_2^-$) in the solution. The reaction involved is illustrated by the following equation:

$$4PdI_4^{--} + BH_4^- + 8OH^- \rightarrow 4Pd\downarrow + BO_2^- + 16I^- + 6H_2O$$

The precipitated palladium then is removed from the spent alkaline solution in a suitable manner, such as by centrifuging, filtering, decanting, etc. If the precipitated gold has not previously been removed from the spent alkaline solution, the precipitated gold and palladium can be removed simultaneously as a mixture as noted above. The borate ions ($BO_2^-$) have no apparent effect on the ability to regenerate the spent solution to substantially its original strength, as will subsequently be described.

As the borohydride compound is added to the alkaline spent solution, the solution will begin to change from a deep red color to black as the black palladium begins to precipitate. Eventually, the black palladium settles out leaving a colorless supernatant liquid. The addition of the borohydride compound then is stopped, since an excess amount thereof may destroy the hypoiodite remaining in the solution.

The determination as to when the precipitation of the palladium in the spent etching solution is complete, may be made in any suitable manner, such as visually, by observing when the solution has become colorless. In the alternative, since the black palladium particles and fines may tend to tint the etching solution and make it difficult to determine when the solution has become colorless, a determination as to when the precipitation of the palladium is complete may be accomplished electrically where the metallic gold has been removed from the solution, by inserting a palladium electrode and a calomel reference electrode in the solution. A change in the voltage across the electrodes from a gradual decrease to an abrupt decrease then indicates that the precipitation of the palladium is essentially complete.

After removal of at least the gold from the spent alkaline solution, the solution is made acidic-to-neutral in a suitable manner. For example, strong acid, such as sulfuric acid or hydriodic acid, may be added to the solution, thus changing the potassium hypoiodite (KOI) and some of the potassium iodide (KI) in the solution to iodine ($I_2$). By way of illustration, the use of sulfuric acid ($H_2SO_4$) for this purpose produces a potassium sulfate precipitate ($K_2SO_4$), which then is removed in a suitable manner, such as by filtering at room temperature. The reaction involved is illustrated by the following equation:

$$KOI + KI + H_2SO_4 \rightarrow I_2 + K_2SO_4 + H_2O$$

In the alternative, the spent alkaline solution may be made acidic-to-neutral without forming a precipitate and the necessity for subsequent filtering of the precipitate, by using hydriodic acid (HI). The reaction involved is illustrated by the following equation:

$$KOI + 2HI \rightarrow I_2 + KI + H_2O$$

The spent alkaline solution also may be made acidic-to-neutral without the forming of a precipitate and the necessity for subsequent filtering of the precipitate, by using an ion exchange resin (in acid form RH) for adding acid to a solution. The reaction involved, using an ion exchange resin containing a sulfonic acid group ($RSO_3H$), is illustrated by the following equation:

$$KOI + KI + 2RSO_3H \rightarrow I_2 + H_2O + 2RSO_3K$$

In the etching of gold using a potassium iodide-iodine etching solution, since the iodine is reduced to iodide as it dissolves the gold, the amount of iodine in the solution should decrease and the amount of potassium iodide in the solution should increase. It has been found, however, that in practice the amount of both of these components in the etching solution generally decreases, the decrease in the potassium iodide apparently occurring as a result of "drag out" as the etched substrates are removed from the etching solution. Accordingly, to regenerate the spent etching solution to its original composition it generally is necessary to add both iodine and potassium iodide to the spent solution.

When the spent alkaline solution is made acidic in nature to produce iodine in the solution as above described, the solution is adjusted back up to at least a substantially neutral pH (i.e., 7.0), and preferably to a pH on the order of 9.0, before filtering any precipitate, such as potassium sulfate, from the solution, and before adding replenishment potassium iodide and iodine to the solution. Additional potassium iodide and iodine, preferably in crystal form, then are added to the spent solution, as necessary, to restore the solution to substantially its original composition and strength. This restoration may be accomplished by measuring the potassium iodide and iodine contents of the solution using standard titration methods, and then adding appropriate amounts of potassium iodide and iodine to the solution to produce an etching solution comparable in etching strength to a fresh batch of the etching solution.

For consistency in manufacturing operations, in determining the amount of potassium iodide and iodine which must be added to the spent solution, the fact that the solution may be saturated with an additional compound, such as potassium sulfate, may be taken into consideration to maintain the weight relationship between the potassium iodide and the iodine, if so desired. For example, a typical initial fresh batch of potassium iodide-iodine etching solution may consist of 57 liters of water (36.07% by weight), 64 kilograms of potassium iodide (40.51% by weight) and 37 kilograms of iodine (23.42% by weight), producing a batch weight of 158 kilograms. Assuming a solubility of potassium sulfate in water of 120 grams/liter (*Chemical-Physics Handbook*, page 637, 1962, Forty-Fourth Edition), the weight of potassium sulfate in the 57 liters of water then is 6.84 kilograms. Thus, the makeup, by weight, of the regenerated etching solution, having a batch weight of 164.84 kilograms, adjusted to retain the same weight relationship between the potassium iodide and the iodine in the solution would be 34.58% water, 38.83% potassium iodide, 22.45% iodine and 4.14% potassium sulfate.

In adding potassium iodide and iodine to regenerate the spent etching solution, the addition of the potassium iodide and the iodine increases the weight and the volume of the solution during the addition process, introducing a continuously changing variable which must be taken into consideration in order to achieve the desired relationship between the potassium iodide and the iodine in the regenerated solution. In this connection, the makeup of the regenerated etching solution can be computed approximately by the following equation:

$$W_t = \frac{w\,(100 - a - b)}{c + d}$$

where $W_t$=weight of the regenerated etching solution after the addition of new potassium iodide and iodine; w=weight of the spent etching solution after removal of gold and palladium, but before the addition of new potassium iodide and iodine; a=percent weight of iodine in the spent etching solution; b=percent weight of potassium iodide in the spent etching solution; c=percent weight of water in the regenerated etching solution; and d=percent weight of additional compounds (e.g., potassium sulfate) in the regenerated etching solution.

In addition, the weight of iodine to be added, $W_{ia}$, can be computed from the equation $$W_{ia} = \frac{e \cdot W_t - a \cdot w}{100},$$

where e=the desired percentage, by weight, of iodine in the regenerated etching solution, and "$W_t$", "a" and "w" are defined as noted hereinabove. Similarly, the weight of potassium iodide to be added, $W_{kia}$, can be computed from the equation $$W_{kia} = \frac{f \cdot W_t - b \cdot w}{100},$$

where f=the desired percentage, by weight, of potassium iodide in the regenerated etching solution, and "$W_t$," "b" and "w" are defined as noted hereinabove.

The following are examples illustrating some of the embodiments of the invention:

EXAMPLE I

Sodium hydroxide was added to one liter of spent potassium iodide-iodine etching solution. Gold precipitated out of the solution and was removed by filtering. The precipitated gold was washed and dried and found to weigh 20.856 grams. The filtered solution was found by atomic absorption spectroscopy to contain 13.2 ppm gold and 550 ppm palladium.

EXAMPLE II

A spent potassium iodide-iodine solution was found by atomic absorption spectroscopy to contain 21.64 grams of gold per liter and 1.00 grams of palladium per liter. To one liter of this spent etching solution, which had an initial pH of 8.0, potassium hydroxide was added with good stirring. The solution heated up and the brownish iodine color gradually disappeared. At a pH of 12.5 gold began to precipitate. At a pH of 13.5 the solution had a reddish color. The reddish solution was decanted from the precipitated gold and found by atomic absorption spectroscopy to contain 3.8 ppm gold and 830.0 ppm palladium. The precipitated gold was washed and dried, and found to weigh 21.789 grams. Separate assays of a sample of the gold precipitate showed 99.36±0.2% and 99.56±0.2% gold.

EXAMPLE III

To the decanted solution of Example II, 50% by weight sulfuric acid was added with good stirring until the solution was at a pH of 7.0. A potassium sulfate precipitate which formed during this step was filtered off after cooling the solution to room temperature. Iodine equivalent to the weight of the gold precipitated (equal to about 12% of the initial iodine weight) was added to the solution. This solution was tested for etching power on gold-palladium pattern-generated circuits at 50° C. with good stirring and found to etch the gold and palladium in 25–30 seconds, even with dissolved palladium in the solution, which is comparable to the etch rate of a fresh batch of potassium iodide-iodine etching solution.

EXAMPLE IV 10.01785 grams of pure gold (99.99%) was dissolved in an etching solution containing 361.13 grams of water, 336.00 grams of potassium iodide and 194.25 grams of iodine, producing a gold solution of 891.38 grams. It was calculated that the resultant solution contained $11.238\times10^{-3}$ grams of dissolved gold per gram of solution. Two analysts, working separately, then analyzed the solution for gold by precipitation of the gold with excess potassium hydroxide. The mean value of five tests performed by the analysts was $11.214\times10^{-3}$ grams of precipitated gold per gram of solution, for a deviation from the initially calculated gold content of −0.21%. The deviation from the mean in the tests was ±0.25%.

EXAMPLE V

To 244 pounds of spent potassium iodide-iodine solution in a lined barrel, potassium hydroxide was added while stirring the solution with a fast recirculating pump. The solution had an initial temperature of 21.6° C. and a pH of 4.5. After 55 minutes the solution temperature had risen to 35.3° C. and the solution had a pH of 11.5. After another 40 minutes the solution temperature had risen to 46.7° C. and the solution had a pH of 13.93, at which time the addition of potassium hydroxide was stopped. The total potassium hydroxide added was 11.267 kilograms. The solution was cooled to 25° C., at which temperature the pH was found to be 13.94. A sample of the solution was found by atomic absorption spectroscopy to contain 120 ppm gold and 550 ppm palladium. The solution subsequently was processed in a centrifuge and clear liquid emerged. The centrifuged gold was washed and dried, and found to weigh 1573.1 grams, for a recovery of 6.45 grams of gold per pound of initial solution.

EXAMPLE VI

To approximately 22.6 liters of the solution of Example V, from which gold had been removed by the centrifuge, sulfuric acid was added with good stirring until the pH of the solution was 7.0. A resultant potassium sulfate precipitate was removed by filtering at room temperature. By potentiometric titration with thiosulfate ($S_2O_3^{--}$) and silver nitrate ($Ag^+$), respectively, it was calculated that the iodine content of the spent etching solution was 62.4 grams per liter and that the potassium iodide content was 416.71 grams per liter. A total of 11.808 kilograms of iodine and a total of 12.184 kilograms of potassium iodide then were added to the solution in three stages in an attempt to reconstitute the solution to the composition of a fresh batch of etching solution. The final regenerated solution had a volume of 28.317 liters. By potentiometric titration as above, and without taking into consideration the potassium sulfate in the solution, it was calculated that the regenerated solution had a composition, by weight, of 36.7% water, 23.3% iodine and 40.0% potassium iodide, as compared to a typical fresh batch composition of 36.08% water, 23.42% iodine and 40.51% potassium iodide.

EXAMPLE VII

To a part of spent alkaline solution of the Example V, from which gold had been removed by the centrifuge, a solution of 50% by weight sulfuric acid and water was added to adjust the pH of the solution from 14.0 to a pH of 3.5. Then, 50% potassium hydroxide water solution was added to the solution to adjust the pH of the solution back up to 6.5. The solution was siphoned at room temperature through a coarse sintered glass sparging tube into a polypropylene lined metal barrel to separate out a resultant potassium sulfate precipitate. By potentiometric titration with thiosulfate and silver nitrate, respectively, the iodine content of the solution was calculated to be 8.319% by weight and the potassium iodide content of the solution was calculated to 26.930% by weight. The solution now weighed 100 pounds.

The additional iodine ("$W_{ia}$") and the additional potassium iodide ("$W_{kia}$") which had to be added to the 100 pounds of solution to produce a regenerated etching solution having a desired composition as described hereinabove, of 34.58% water ("c"), 22.45% iodine ("e"), 38.83% potassium iodide ("f") and 4.14% potassium sulfate ("d"), by weight, were then determined using the above-mentioned formulas $$W_t = \frac{w(100 - a - b)}{c + d}, \quad W_{ia} = \frac{e \cdot W_t - a \cdot w}{100}, \text{ and } W_{kia} = \frac{f \cdot W_t - b \cdot w}{100}.$$

In this connection, the weight "$W_t$" of the final solution was computed to be $$100\ \frac{(100 - 8.319 - 26.930)}{(34.58 + 4.14)} = 167.2 \text{ pounds.}$$

The weight "$W_{ia}$" of iodine to be added then was computed to be $$\frac{(22.45)(167.2) - (8.319)(100)}{100} = 29.22 \text{ pounds or } 13.266 \text{ kilograms,}$$

and the weight "$W_{kia}$" to be added was computed to be $$\frac{(38.83)(167.2) - (26.930)(100)}{100} = 37.99 \text{ pounds or } 17.247 \text{ kilograms.}$$

13.266 kilograms of iodine and 17.247 kilograms of potassium iodide then were added to the solution. After stirring the solution with a pump, a 150 cc sample was taken and by titration as above the content of iodine was calculated to be 21.98%, in comparison to the desired content of 22.45%, for an error of only −0.47%, while the content of potassium iodide was calculated to be 39.40%, in comparison to the desired content of 38.83%, for an error of only +0.57%.

EXAMPLE VIII

The regenerated solutions of Examples VI and VII were combined into a single batch weighing 280 pounds. The combined solution was utilized in a spray etcher to etch gold-palladium substrates on a production basis. The regenerated solution etched 8,192 substrates before becoming spent, which is comparable to the etching capacity of a fresh potassium iodide-iodine etching solution.

EXAMPLE IX 500 ml of spent potassium iodide-iodine etching solution having a pH of 13.5 and from which gold had been removed by precipitation with potassium hydroxide and filtering, was placed in a beaker fitted with a magnetic stirrer, thermometer and pH electrodes. Potassium borohydride was slowly added at room temperature from a preweighed vial. An instantaneous reaction occurred, the deep red color of the palladium iodide complex disappearing and being replaced by a black (palladium) precipitate which rapidly agglomerated and settled, leaving a water-white solution. No temperature or pH change was observed. After decanting the supernatant liquid, the liquid was analyzed by atomic absorption spectroscopy and found to contain 3 ppm gold and 11 ppm palladium. The vial containing the potassium borohydride powder was reweighed and it was found that 0.416 grams of potassium borohydride had been used to precipitate the palladium from the solution. Upon washing and drying the palladium, 2.537 grams of palladium was recovered, giving a ratio of 3.1 moles palladium per mole of potassium borohydride reaction.

EXAMPLE X

An etching solution saturated with potassium sulfate ($K_2SO_4$) and containing a concentration of potassium borate ($KBO_2$) greater than that which would be expected after one hundred regenerations of an aqueous potassium iodide-iodine etching solution, was prepared by adding 10.8 grams (0.2 moles) potassium borohydride ($KBH_4$) to 150 grams of water. The potassium borohydride was decomposed to potassium borate by adding sulfuric acid ($H_2SO_4$). 168.4 grams of potassium iodide (KI) and 97.4 grams of iodine ($I_2$) then were added to the solution, producing 200 ml of a solution 1.0 molar in borate ions ($BO_2^-$). Potassium hydroxide was added to the solution and the solution was adjusted to a final pH of 8.5 by adding additional sulfuric acid, producing a potassium sulfate precipitate which was filtered off after cooling the solution to 22° C. The resultant solution etched gold-palladium substrates cleanly in 20 seconds, at 50° C., which is comparable to the etching rate of a fresh batch of aqueous potassium iodide-iodine etching solution containing no potassium sulfate and potassium borate.

EXAMPLE XI

Spent potassium iodide-iodine solution containing both gold and palladium was made basic to a pH of 13.5 by the addition of potassium hydroxide. Gold precipitated, leaving palladium iodide in solution. Without filtering the gold off, potassium borohydride powder was added to the resultant warm solution with stirring. Palladium metal precipitated and mixed with the gold, the combined metals quickly settling and leaving a clear supernatant liquid which could be decanted for regeneration.

EXAMPLE XII

A coiled wire palladium electrode and a calomel reference electrode were inserted in 100 cc of a spent alkaline potassium iodide-iodine etching solution from which the gold had been removed and which contained approximately 0.5 grams of dissolved palladium ($Pd^{++}$) per liter of solution. As the spent solution was titrated with 0.1 molar potassium borohydride the voltage across the electrodes was measured. The initial voltage was −124 millivolts. When 3.50 cc of the potassium borohydride had been added, the voltage had decreased to −180 millivolts. Upon the addition of another 0.5 cc of the potassium borohydride the voltage abruptly decreased to −417 millivolts. At this time, the spent solution was essentially colorless and metallic palladium (Pd) had been precipitated. The precipitated palladium was recovered, washed, dried at 120° C. and weighed, and found to be 0.839 grams of palladium per liter of solution.

INDUSTRIAL APPLICATION

In summary, a relatively simple and economical method of recovering gold and palladium from a spent potassium iodide-iodine etching solution, and regenerating the etching solution for reuse, has been disclosed. The method involves adjusting the etching solution to a strongly basic pH on the order of at least 12.5 by adding an alkaline compound, such as potassium hydroxide, to the etching solution, to precipitate metallic gold from the solution. Metallic palladium may be precipitated from the alkaline solution by the addition of a borohydride compound, such as potassium borohydride. Following removal of the precipitated gold and palladium, the spent alkaline solution is made acidic-to-neutral in pH, as for example by the addition of a strong acid, such as sulfuric acid, to change potassium hypoidite and some potassium iodide in the solution to iodine. The solution then preferably is adjusted back upward to a pH on the order of 9.0, after which any precipitate, such as potassium sulfate, is removed by filtering at room temperature. Potassium iodide and iodine crystals then are added to the solution, as necessary, to regenerate the solution to substantially its original composition and strength for reuse.

What is claimed is:

1. A method of recovering gold from an aqueous potassium iodide-iodine etching solution, which comprises:

adjusting the etching solution to a strongly basic pH to precipitate metallic gold from the etching solution; and removing the precipitated metallic gold from the resulting alkaline solution.

2. The method as recited in claim 1, in which the etching solution is adjusted to a pH on the order of at least 12.5.

3. The method as recited in claim 1, in which the etching solution is adjusted to a strongly basic pH by the addition of potassium hydroxide.

4. A method of regenerating an aqueous potassium iodide-iodine etching solution, which comprises:

adjusting the etching solution to a strongly basic pH to precipitate metallic gold from the etching solution;

removing the precipitated gold from the resulting alkaline solution;

adjusting the alkaline solution to a neutral pH to change iodine compounds in the solution to iodine; and adding iodine to the solution to regenerate the etching solution.

5. The method as recited in claim 4, in which the etching solution is adjusted to a pH on the order of at least 12.5 to precipitate the gold from the etching solution.

6. The method as recited in claim 4, in which the etching solution is adjusted to a strongly basic pH by the addition of potassium hydroxide.

7. The method as recited in claim 4, in which:

the alkaline solution is adjusted to an acidic-to-neutral pH by the addition of sulfuric acid to produce a potassium sulfate precipitate; and which further comprises:

removing the potassium sulfate precipitate from the solution prior to adding the iodine to the solution to regenerate the etching solution.

8. The method as recited in claim 4, in which:

the alkaline solution is adjusted to an acidic-to-neutral pH by the addition of hydriodic acid.

9. The method as recited in claim 4, in which:

the alkaline solution is adjusted to an acidic-to-neutral pH using an ion exchange resin.

* * * * *